US005226438A

United States Patent [19]

Dubinsky

[11] Patent Number: 5,226,438

[45] Date of Patent: Jul. 13, 1993

[54] UMBRELLA WITH SPECIAL LINING ATTACHED TO UNDERSIDE OF RIBS TO STABILIZE THE RIBS AND PERMIT EASY REMOVAL OF TOP CANOPY

[76] Inventor: Emanuel Dubinsky, 3 Cross Ridge Rd., Chappaqua, N.Y. 10514

[21] Appl. No.: 765,540

[22] Filed: Sep. 25, 1991

[51] Int. Cl.[5] ..... A45B 25/22

[52] U.S. Cl. ..... 135/33.4; 135/33.2

[58] Field of Search ..... 135/33.2, 33.4, 33.41, 135/33.5

[56] References Cited

U.S. PATENT DOCUMENTS

| | | | |
|---|---|---|---|
| 109,775 | 11/1870 | Stephens | 135/33.2 |
| 121,625 | 12/1871 | Jacquin | 135/33.41 |
| 230,658 | 8/1880 | Ray | 135/33.41 |
| 556,846 | 3/1896 | Den Hartog | 135/33.41 |
| 719,269 | 1/1903 | Slyder | 135/33.4 |
| 1,431,775 | 10/1922 | Cannon | 135/33.4 |
| 2,453,270 | 11/1948 | Russell | 135/33.4 |

*Primary Examiner*—Henry E. Raduazo
*Attorney, Agent, or Firm*—Philip Young

[57] ABSTRACT

A garden umbrella with its underside covered with a lining material that is attached to the ribs. The lining material extends from the runner ribholder, that moves along the umbrella pole, across both the stretcher ribs and the canopy ribs to the ends of the ribs such that the underside of the umbrella is fully covered by the lining. Cloth tabs are sewn onto the lining at selected locations where spring clips secure the cloth tabs and lining to the stretcher ribs and canopy ribs, whereby the lining, the tabs and the clips act to stabilize the ribs from unwanted movement. The use of the lining permits employment of an easily removable umbrella canopy for servicing or replacement with other canopies. Also, the configuration of the lining across the underside of the umbrella is designed to provide a wind deflector which reduces the lift effect of wind against the bottom of the umbrella.

3 Claims, 3 Drawing Sheets

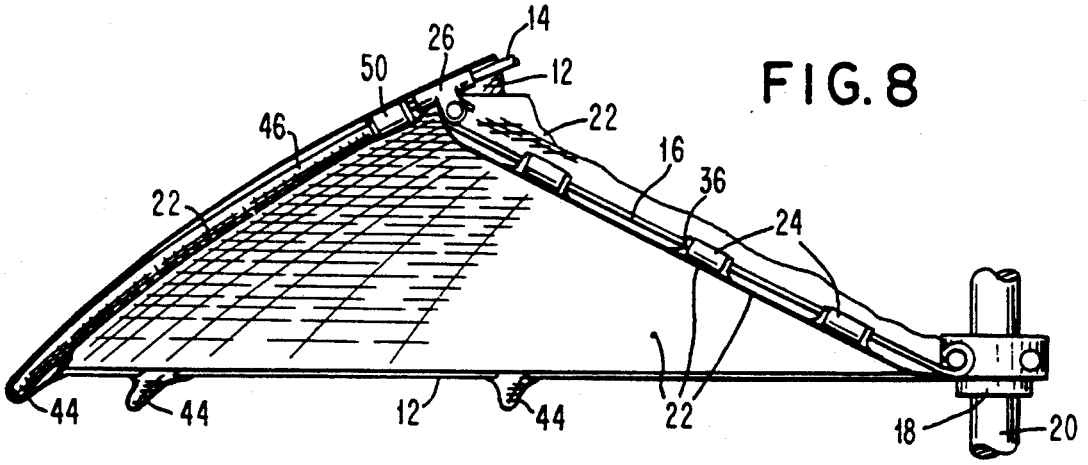
FIG. 8
FIG. 9
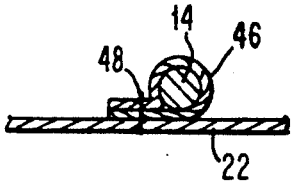
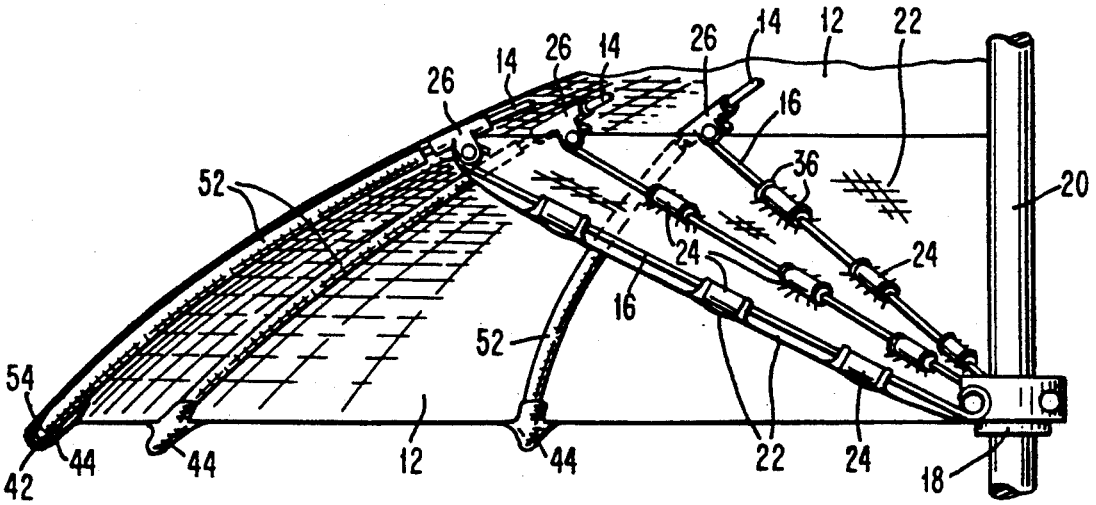
FIG. 10

UMBRELLA WITH SPECIAL LINING ATTACHED TO UNDERSIDE OF RIBS TO STABILIZE THE RIBS AND PERMIT EASY REMOVAL OF TOP CANOPY

BACKGROUND OF THE INVENTION

Field of The Invention

The present invention relates to umbrellas and, more particularly, to umbrellas of the generally large size used outdoors in the patio and garden and commonly referred to as "garden umbrellas".

Background Art

The conventional umbrellas and, more particularly, the larger sized patio and garden umbrellas generally are made with a rib support system attached to a means for extending and retracting the ribs to respectively open and close the umbrella. Of course, the umbrella has a canopy that is secured to the rib support system such that the canopy is maintained secured to the ribs. One problem with umbrellas is that the wind can lift the underside of the canopy and force it into an inside out configuration, often destroying the canopy and the rib support structure. The top canopy may be attached to the ribs for the purpose of holding the canopy down against upward wind gusts and to prevent the undesirable movement and shifting of the ribs from their initially aligned positions in spaced apart relation along the canopy. These attachments of the canopy are disadvantageous from the standpoint that they may prevent the canopy from being easily removed from the ribs for servicing or replacement. This, in turn, may limit the stability and durability of the umbrella.

SUMMARY OF THE INVENTION

It is an object of the present invention to provide an umbrella which is stable and has high resistance to wind. It is another object to provide an umbrella having means for stabilizing the ribs against relative movement, while at the same time permitting the top canopy cover to be easily removed for servicing or replacement. It is another object to provide an umbrella with means for aerodynamically reducing the undesirable effects of wind at the underside of the umbrella. It is still another object to provide an umbrella that conceals the rib support structure from view and is appealing to the eye.

These, and other objects, are achieved by the present invention which provides a garden umbrella with its underside lining material that is attached to the ribs. The lining material extends from the runner ribholder, that moves along the umbrella pole, across both the stretcher ribs and the canopy ribs to the ends of the ribs such that the underside of the umbrella is fully covered by the lining. Attachment means for the lining include a material, in the form of a long cloth tube or a tab, that is sewn along the lining and also secured around the umbrella ribs. The cloth tube or tabs are attached at selected locations to the stretcher ribs and canopy ribs, whereby the lining, the cloth tubes and the tabs act to stabilize the ribs from unwanted movement. The stabilizing function provided by the liner and rib attachments permit use of an easily removable umbrella canopy for cleaning or exchange with other canopies. Also, the configuration of the lining across the underside of the umbrella is designed to provide a wind deflector which reduces the lift effect of wind against the bottom of the umbrella.

BRIEF DESCRIPTION OF THE DRAWINGS

FIG. 8 is a partial sectional view of the lining and rib attachment according to another embodiment of the invention;

FIG. 9 is a close-up view of the tube attachment means for the lining and ribs shown in FIG. 8; and FIG. 10 is a partial sectional view of the lining and rib cover means according to still another embodiment of the present invention.

DESCRIPTION OF THE PREFERRED EMBODIMENTS

Figure 1:
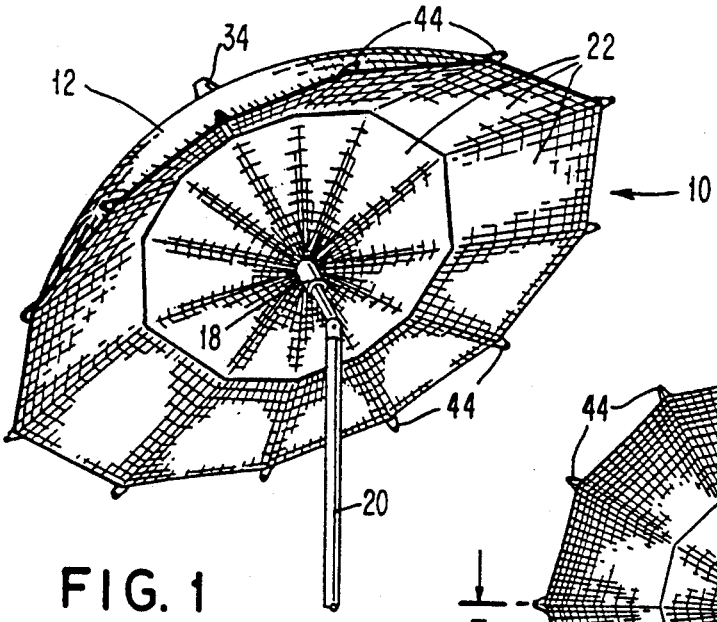
FIG. 1 is a perspective view of an overall umbrella taken from the underside of the umbrella, illustrative of the present invention.
Figure 2:
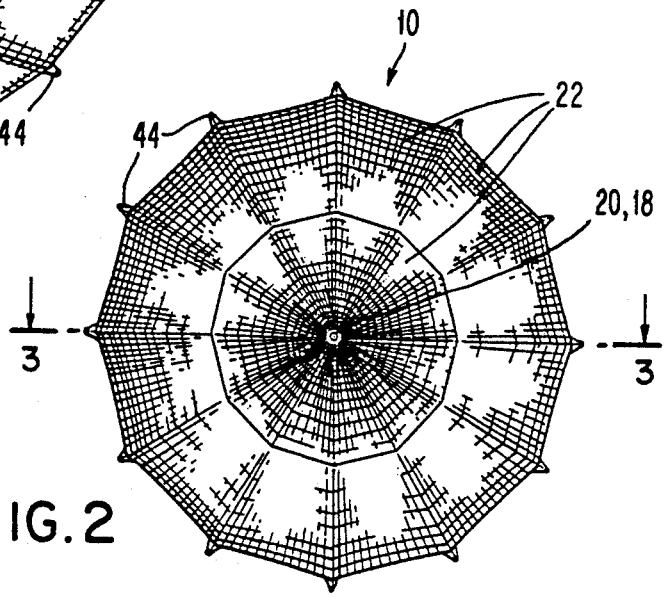
FIG. 2 is a bottom view of the umbrella, showing the full lining covering the underside of the umbrella.
Figure 3:
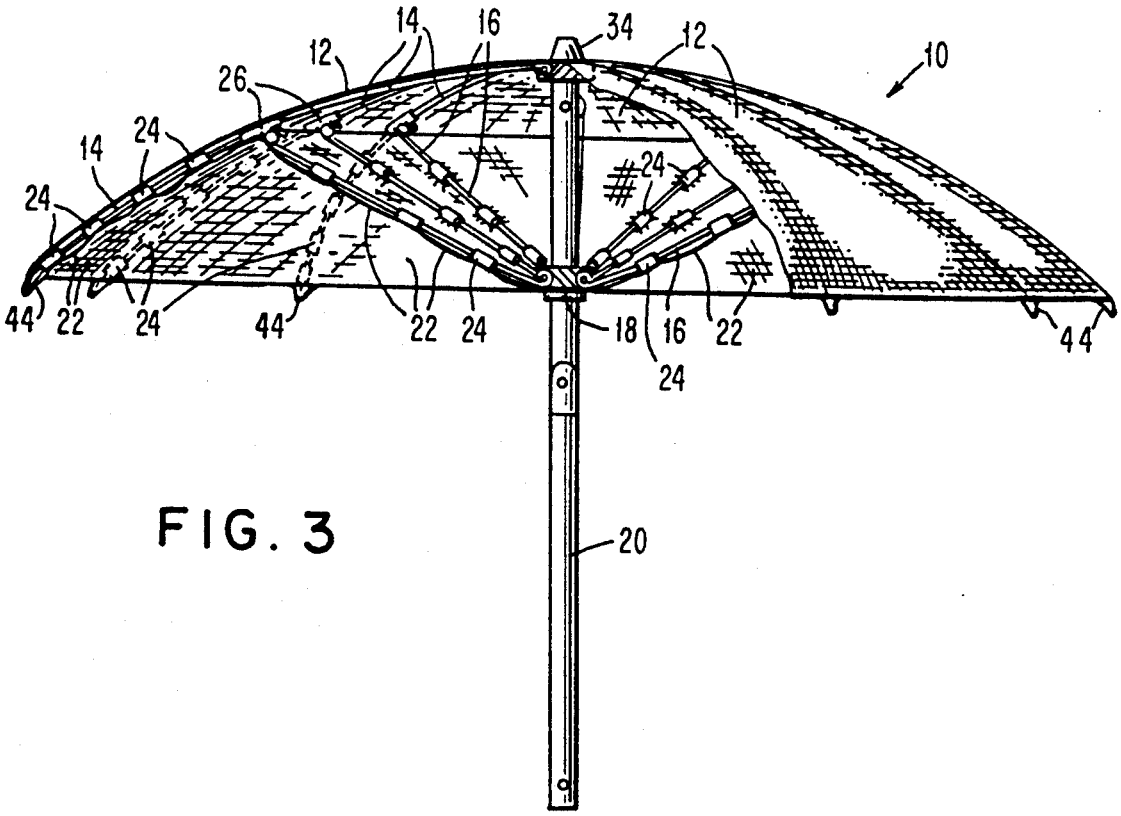
FIG. 3 is a side view, taken partially in section along section 3—3 of FIG. 2, showing the lining material and the attachment means to the rib support structure.
Figure 7:
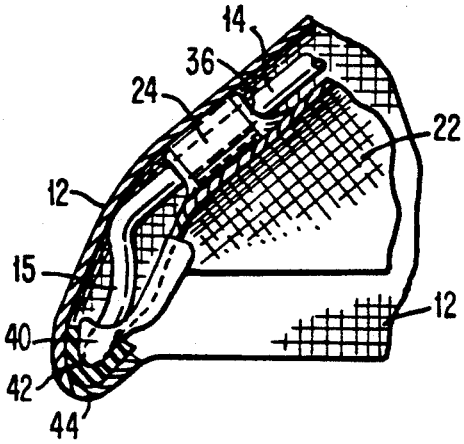
FIG. 7 is a close-up view of the end of the umbrella rib, including details of the lining and the canopy at the rib end.

Referring to FIGS. 1, and 2, there are respectively shown views taken from a perspective and the underside of a garden umbrella 10 having a top canopy 12 and a frame including canopy support ribs 14, stretcher ribs 16 and a runner notch 18. As used herein, the terms "frame" and "frame support ribs" may include the canopy support ribs 14 and the stretcher ribs 16. The runner notch 18 includes a ribholder, shown in the side view of FIG. 3, that pivotally attaches to the stretcher ribs 16 and is adapted to slide vertically along an umbrella pole 20. Typically, for garden umbrellas, the pole 20 extends through a table top, not shown, and is supported at its lower end by a heavy base or footing member, not shown. The stretcher ribs 16 are connected in the conventional manner to the ribholder runner notch 18 at their lower end, and connected at their upper ends by means of a connector 26 and pivot pins 28, shown in FIG. 5, to the canopy support ribs 14. An umbrella lining 22 is adapted to cover the underside of the umbrella and extends from the runner notch 18, across the stretcher ribs 16 and support ribs 14, to the ends 15 of the support ribs 14 as further detailed in FIG. 7. As shown in FIGS. 1, 2 and 3, the lining 22 generally covers the underside of the umbrella 10, including the rib support structure. The stabilizing means for the umbrella includes the liner and its attachment means to the rib support structure. More specifically, the lining 22 is made of a strong support material, such as cotton, vinyl, acrylic, polyester, synthetic stitch bonded fabrics that are supple and pliable in nature. The lining 22 is secured to the stretcher ribs 16 and the support ribs 14 by cloth fabric tabs 36, shown in detail in FIGS. 5 and 6, that are sewn onto the lining 22 by stitches along seam 38 and secured by spring clips 24 at selected locations to the stretcher ribs 16 and support ribs 14. It is noted that the cloth fabric tabs 36 contact the ribs directly, rather than the clips 24, thereby providing a soft, cushioned contact with the ribs and eliminating wear and tear as well as noise that may take place if a clip member, such as metal or rigid plastic, were to be in direct contact with ribs.

Figure 4:
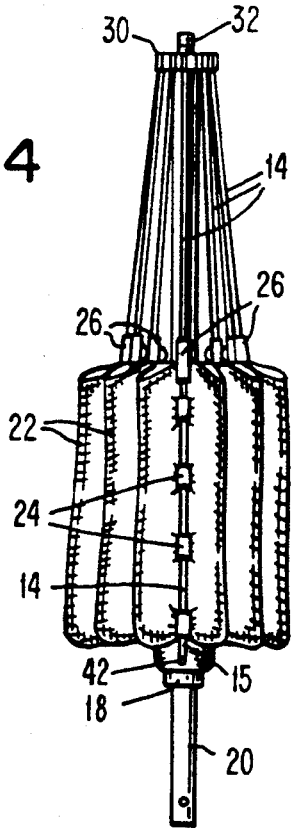
FIG. 4 is a perspective view of the rib support structure, the lining and the attachment means, without the canopy, with the umbrella in the closed position.
Figure 5:
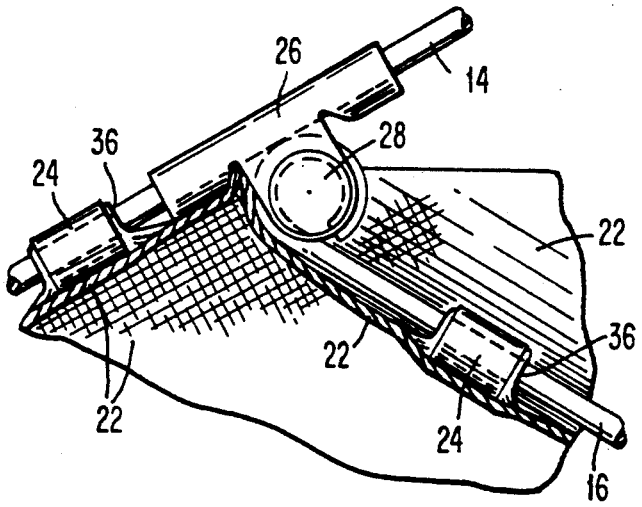
FIG. 5 is a close-up view of the area around the rib stretcher and rib joint, including details of the lining and attachment means.
Figure 6:
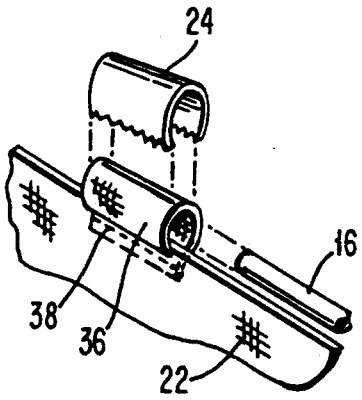
FIG. 6 is a close-up view of the tab and clip attachment means for securing the lining to the ribs.

The lining 22 extends closely around the rubber notch 18 and may be further secured by a rope tie, not shown, to such runner notch 18. As shown in FIGS. 1–7, the lining covers the stretcher ribs 16 and is secured thereto by the tabs 36 and clips 24. The lining 22 further extends past the rib connectors 26, as shown in FIGS. 3 and 5, and is further attached to the support ribs 14 by the tabs 36 and clips 24 at the sections of the support ribs 14 that extend below the connectors 26 to the rib ends 15. A conventional top ribholder 30 pivotally connects the upper ends of support ribs 14, as shown in FIG. 4, and a top screw 32 is attached to a top cap 34 located on top of the center of the canopy cover 12. The outer periphery of the lining 22 has a small material lining pocket 40, shown in FIG. 7, into which fits each of the rib ends 15. A plastic tip cap 42 is press fitted over the lining pocket 40 and the rib end 15 to provide a relatively smooth, curved surface onto which the fabric pocket 44 of the canopy cover 12 is tightly fitted. Each of the rib ends 15 is attached to a lining pocket 40, a plastic tip cap 42 and a pocket 44 of the canopy 12.

In this fashion, the lining 22 and its special attachment means to the stretcher ribs 16 and support ribs 14 act to stabilize and support the umbrella such that the ribs will be prevented from shifting and bending due to wind pressures. With the secure lining 22 being secured to and covering the ribs in this manner, the wind exerted against the undercover of the umbrella will be aerodynamically deflected so as to have a reduced or minimum force which might otherwise cause the lining, the top canopy or the rib support structure to be damaged. One additional function and advantage of the lining and attachment means of the present invention is that of permitting the top canopy cover 12 to be easily removed for servicing or replacement. Here, the canopy cover 12 need not have a support and attachment means to attach the canopy cover 12 to the support ribs 14. Rather, the canopy cover 12 is simply secured to the ribs by tightly overlapping the canopy cover pocket 44 around each rib 14 and its plastic tip cap 42.

FIG. 8 shows another embodiment of the invention wherein the full fabric lining 22, as described above, is provided with a long cloth or other fabric tube 46 which, as shown in FIG. 9, is sewn along stitch line 48 to the lining 22 at the rib locations. The tube 46 may extend the full length of the support rib 14 below the connector 26, or may be shorter, depending on the desired length of the connection between the ribs 14 and the lining. As shown in FIG. 9, the rib 14 extends through the center of the tube 46. It is noted that a metal spring clip 50 may be employed to prevent shifting of the tube 46, but will not be required where the tube 46 extends the full length of the rib 14, as shown. The ends of the tube 46 may be covered by the plastic tips 42 in the manner described above for the lining 22 as shown in FIG. 7.

FIG. 10 shows still another embodiment of the invention wherein the lining 22 extends from the ribholder 18 to the connector 26, such that the lining 22 covers only the stretcher ribs 16. Here, a long cloth tube 52 is adapted to cover the rib 14 from the connector 26 to the rib end 15 and such that tube 52 has an end 54 which is folded over at the rib end and covered by the plastic tip cap 42 and further covered by the pocket 44 of the canopy as above the respect to FIG. 7. Here, in some cases it may be desirable to expose the canopy at its lower end below the connector 26.

While the invention has been described above with respect to its preferred embodiments, it should be understood that other forms and embodiments may be made without departing from the spirit and scope of the present invention.

What is claimed is:

1. In an umbrella having an umbrella pole, frame support ribs including canopy cover ribs having an upper side and an underside and stretcher ribs, said canopy cover ribs being pivotally connected to said stretcher ribs for opening and closing said umbrella, said canopy cover ribs having upper ends pivotally connected to said umbrella pole at a top portion thereof, each of said canopy cover ribs having a lower end with an end tip portion, a ribholder connected to one end of each of said stretcher ribs and encircling said umbrella pole and adapted for slidable movement along said umbrella pole for extending and retracting said frame support ribs for respectively opening and closing said umbrella, and a canopy cover located on top of said canopy cover ribs, the improvement of which comprises:

(a) a lining material adapted for covering the underside of said canopy cover ribs and said frame support ribs, said lining material extending from said ribholder across said stretcher ribs to said canopy cover ribs; and (b) attachment means including long fabric tubes sewn onto said lining material and extending adjacent to and along a substantial length of said canopy cover ribs for receiving said canopy cover ribs through the interior of said long fabric tubes for thereby attaching said lining material to said canopy cover ribs; and (c) said canopy cover including pocket means adapted for receiving therein said end tip portion of each of said canopy support ribs whereby said canopy cover is removably secured to said canopy cover ribs;

whereby said lining material and said long fabric tubes act to stabilize the umbrella and its frame support ribs and said canopy cover against external forces and permit use of an easily removably canopy cover.

2. An umbrella as recited in claim 1, further comprising a rigid cap for engaging said end tip portion of said canopy rib to cover the same, whereupon said ends of said canopy cover are secured around said rigid cap and said end tip portion.

3. An umbrella as recited in claim 1, wherein said attachment means includes fabric tabs that are attached to said stretcher ribs, and fabric tabs that are attached to said canopy ribs for securing said lining material to said ribs and stabilizing said ribs.

* * * * *